United States Patent [19]

Boatright

[11] Patent Number: 4,536,177

[45] Date of Patent: Aug. 20, 1985

[54] SEPARATOR

[75] Inventor: Donald E. Boatright, Tulsa, Okla.

[73] Assignee: Robert G. Green, Tulsa, Okla.

[21] Appl. No.: 639,671

[22] Filed: Aug. 8, 1984

[51] Int. Cl.[3] ..... B04B 1/04

[52] U.S. Cl. ..... 494/44; 494/34

[58] Field of Search ..... 494/31, 32, 34, 44, 494/53, 54, 56, 65, 85, 901, 40; 210/360.1, 360.2

[56] References Cited

U.S. PATENT DOCUMENTS

| | | | |
|---|---|---|---|
| 1,928,080 | 9/1933 | Uebelacker | 494/40 |
| 2,461,129 | 2/1949 | Strezynski | 494/44 |
| 3,613,988 | 10/1971 | Tapp | 494/44 |
| 3,774,840 | 11/1973 | Boatright | 494/25 |

*Primary Examiner*—Robert W. Jenkins

*Attorney, Agent, or Firm*—Head, Johnson & Stevenson

[57] ABSTRACT

This describes a centrifugal separator for fluid and solid mixtures. The rotating centrifuge assembly includes a structure of two rotating circular cones having transfer veins in which the separation takes place in the veins between the two cones. The cross-sectional area of each such vein increases linearly from the bottom to the top. At the top of the transfer veins there is a dense material transfer vein and a light material transfer vein. One discharge vein is an opening which is slanted backwardly from the motion of the rotating centrifuge assembly to the outside circumference of the centrifuge assembly while the second opening is to the inner vortex of the centrifugal assembly. The inner vortex is connected to a vortex pump which removes the least dense material.

16 Claims, 7 Drawing Figures

SEPARATOR

BACKGROUND OF THE INVENTION

Field of Invention

This invention is in the field of centrifugal separators and is concerned with the separation of two fluid mixtures and fluid solid mixtures. The closest prior art of which I am aware is described in U.S. Pat. No. 3,774,840 issued Nov. 27, 1973, entitled "Centrifugal Separator", Donald E. Boatright, Inventor.

SUMMARY OF THE INVENTION

This invention concerns the centrifugal separation of materials which may be fluids or fluid solids or combinations thereof. There is a rotating centrifuge assembly which includes two rotating inverted truncated right angle circular cones which are supported one inside the other with transfer veins or passages therebetween, which are separated by ribs. These transfer or sector veins gradually increase in cross-sectional area from the bottom to the top. Separation occurs in these transfer veins. Means are provided to inject the fluid or materials to be separated into the transfer veins.

A stabilized circular cone structure fits inside the inner of the rotating cones and is fixed to a housing in which the rotating assembly is mounted. There are special means connected to the outlet of the transfer veins at the upper end for directing the denser material in one flow path and the less dense material into another flow path. Means are also provided to control the back pressure on each of the flow paths. The second flow path is connected to a special vortex pump whose outlet is connected to a light material discharge line. It can retain the fluids and fluid solids in the centrifuge transfer veins as long as necessary by controlling the back pressures. All of the fluids and fluid solids being separated must move into the extreme field of centrifugal force within the transfer veins before they can exit from the centrifuge assembly. These fluids and fluid solids can be retained in the centrifuge transfer veins as long as necessary whereas the prior art provides no such control. The back pressure is controlled in an upper and lower chamber and by the vortex pump.

DESCRIPTION OF THE DRAWINGS

A better understanding of the invention and its objectives can be had from the description taken in conjunction with the drawings in which.

DESCRIPTION OF THE PREFERRED EMBODIMENT

Figure 1:
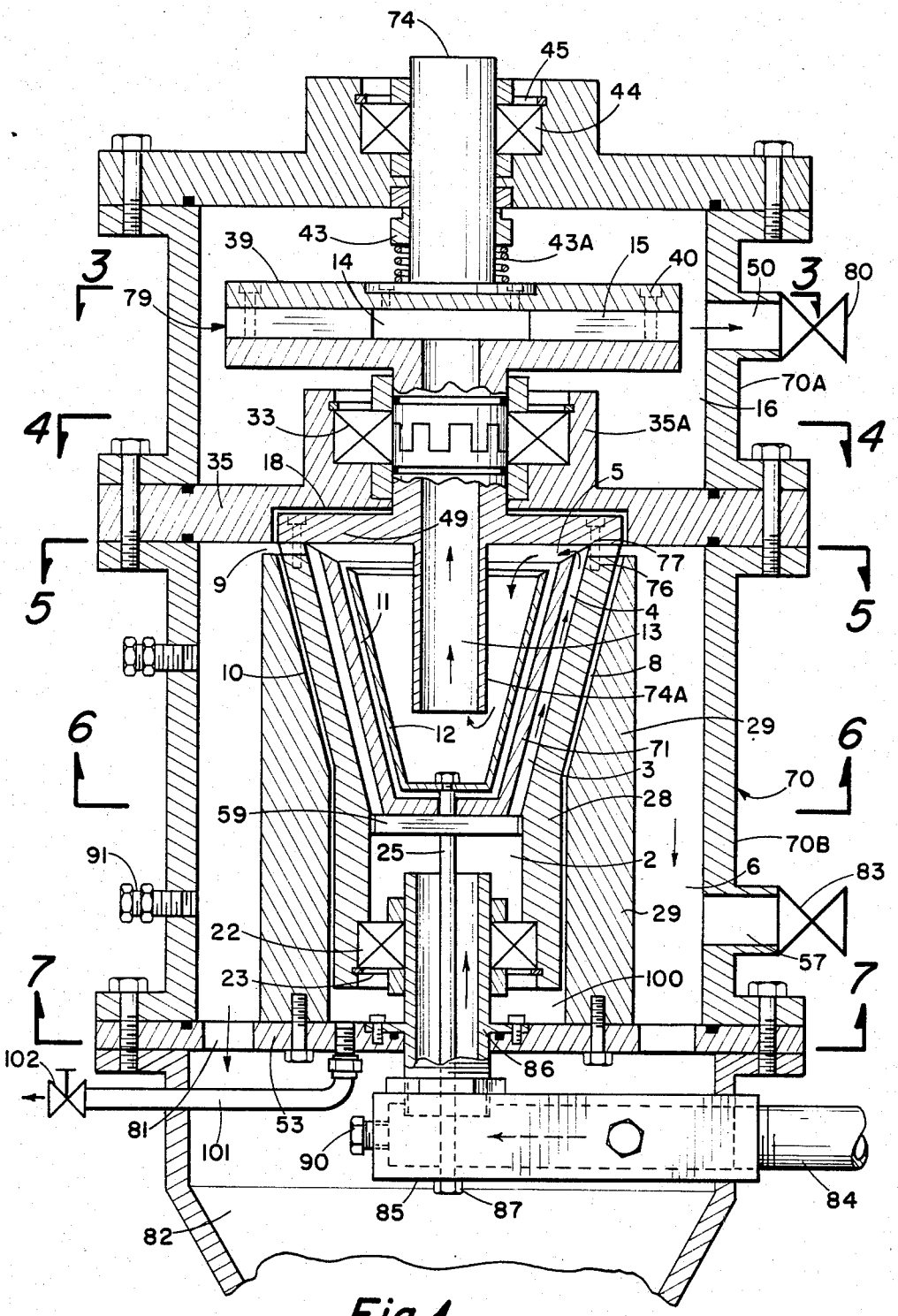
FIG. 1 is an elevation view mostly in section of the separator of this invention.
Figure 2:
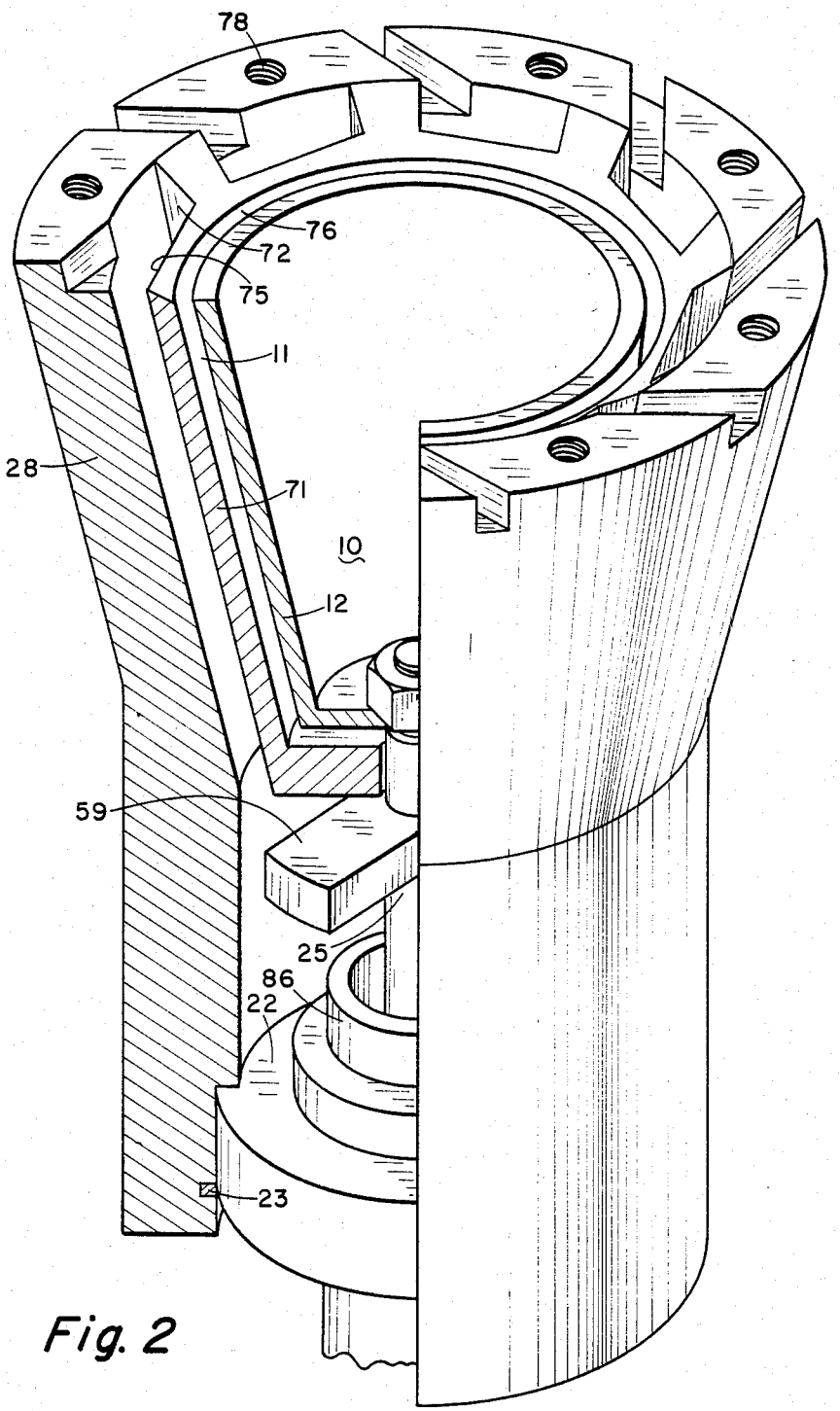
FIG. 2 is an isometric view of the separator centrifuge assembly with a quarter section removed.

Attention is first directed to FIG. 1 which shows a container generally designated 70 having upper section 70A and a lower section 70B for enclosing the separation unit. Within container 70 is a rotating centrifuge assembly which is more clearly shown in FIG. 2. Shown thereon is centrifuge housing 28 and a right circular cone 71 which has grooved on the outside thereof a plurality of ribs 72 forming centrifugal, transfer or sector veins 3 between the cone 71 and the centrifuge housing 28. The centrifuge housing 28 and cone 71 are rotated in unison by rotation of shaft 74. This can be by friction fit or may be fastened together by pins. The ribs 72 are essentially the same size from the bottom of the cone 71 to the top so that each vein 3 expands in cross-sectional area from the bottom to the top.

Inside cone 71 is a vortex fluid stabilizer 12 which is fixed with respect to the container 70. A fluid stabilizer 12 is a stationary inverted right circular cone and its main function is to slow down the turbulence of the materials which are injected into the central vortex 10.

Attention is now directed to the upper end of cone 71. As can be seen, it is sloping from the inner surface 76 to its outer surface 75 which forms a less dense discharge weir. Ribs 72 are also machined or manufactured to continue this sloping up to the top of housing 28. The top part of housing 28 is provided with a plurality of backward slanting dense discharge veins 4. These slope backwardly at a selected angle from the direction of rotation as indicated by the arrow thereon. These veins 4 serve as discharge veins but also may serve as a pumper as well as will be seen. As shown in FIG. 1, these veins 4 have an outlet into heavy material holding chamber 6. An upper centrifuge cover 49 is bolted by bolt 76 to the upper end of housing 28 through holes 77.

There are two paths for the separator fluid to follow. One is the less dense discharge vein 5 and the other is the heavy or more dense discharge vein 4. The less discharge vein is in fluid communication with the light material or dense material vortex chamber 10 which is in communication with vortex transfer vein 13 which is the hollow portin of lower shaft 74A. This is the suction for vortex pump 79 having a vortex pump cover 39 connected with vortex cover retaining bolt 40 and having a dispersion chamber 14 and a vortex pump discharge vein 15. The discharge from pump 79 is into less dense material holding chamber 16 which has a light material discharge line 50 having a valve 80.

There is a scatter wall shield 29 which surrounds housing 28 and a clearance vein 8 therebetween whose primary function is to reduce friction caused by the building up of biosediments, organic and inorganic materials which are passed into the heavy material holding chamber as a result of the separation process. Because of the very close spacing, fluids and solids are centrifuged up and out of the vein by the rotation of the centrifuge wall which, in turn, lets the centrifuge assembly free from the push and drag caused by the build-up of composition condensation of the many micro-organisms found in various materials. Clearance vein 8 opens into a cavity 100. An outlet line 101 extends from this cavity to the exterior of the container 70 and is provided with valve 102. Valve 102 is closed during normal operation but is opened should there be sufficient accumulation of material in cavity 100 to require cleaning. The centrifuge clearance vein 9 is a clearance provided by an upper and lower structure and aided by the force emitted by the materials being discharged from the dense discharge vein 4. This space is between the upper end of scatter wall 29 and central bearing housing retainer plate 35.

Retainer plate 35 serves a three-fold purpose. It has a central hub 35A which is designed to hold a central bearing 33 for the centrifuge shaft 74A of the lower vortex pump shaft. It also holds the two shafts in a concentric alignment with the main shaft bearing 44 and the centrifuge bearing 33. It also provides the top side of the centrifuge cover clearence vein. The central bearing 33 also serves as a means of disassembly or assembly without the necessity of disassembling both upper and lower chambers.

Shaft 74 drives the vortex pump 79 by external means not shown. Main shaft bearings 44 are held in place by snap ring 45 and lock collar. Main shaft mechanical seal assembly 43 with spring 43A seals the main shaft so as to eliminate the loss of material from around the shaft which passes from the outside of the separator and attaches to the pump which is located in the light material holding chambers. A stabilized seal ring may be counter sunk and pressed t the top housing cover and bearing retaining housing in a known manner. The pressure seal and tension spring surrounds the shaft and is held compressed by the pump housing cover plate.

Attention will next be directed to the stationary portion of the structure surrounding the rotating centrifuge assembly. This includesx a bottom housing cover 53 having vertical passages 81 therethrough which is connected to the heavy material holding chamber 6 so that the heavy material can fall into the hopper 82 formed beneath the bottom housing cover 53. As shown in the drawing, the scatter wall shield 29 is connected by bolts to bottom housing cover 53. A heavy material discharge vein 57 having valve 83 is connected to the heavy material holding chamber 6. It should be noted that the scatter shield wall and holding chamber should be passed into the central and end cover flanger. This should be down as good engineering to hold the moving parts in the alignment and serves as a means of balance.

A fluid input circuit is provided. This includes inlet line 84, a square chamber bracket 85 and upwardly directed to upright tube 86 whose interior is hollow and is opened into centrifuge dispursing chamber 2. Centrifuge bearings 22 are provided between the wall of the upright tube 86 and the lower end of centrifuge housing 28. Bearings 22 are held in position by snap ring 23. The centrifuge bearing is located in the lower bottom of the centrifuge housing and forms the bottom of the centrifuge disbursing chamber and seals it so that no material can leak out. Also, it encircles the imput shaft and holds the centrifuge assembly in concentric alignment.

As mentioned earlier, the fluid stabilizer 12 is fixed with respect to container 70. This is accomplished by use of bolt 25 which extends downwardly through housing 85 and is secured there by a nut 87.

Also fixed to container 70 by bolt or rod 25 is a centrifuge knife 59. This knife has been incorporated as a continuous part of the stabilizer shaft so that controlled adjustment can be maintained. It is shown clearly in FIG. 2 as a fixed bar fitted just beneath the bottom position so that the motion of the vortex chamber is used as the cutting motion necessary to cut up those materials which are too large to enter the transfer veins 3.

Since many fluids and fluid solids are the result of micro-organisms and as hydrocarbons of an organic and inorganic nature, it will sometimes be necessary to break up certain bondings by means of heat or chemicals in order to speed up the separation process and maintain a volume of flow which is suitable for certain types of separation process. A material imput adapter plug 90 is provided in block 85 into which chemicals may be injected into the imput vein. Also shown, are adapter plugs 91 and 95 which open into the wall of the container 70 into heavy material holding chamber 6.

It is to be noted that the rotation of pump 79 and the centrifuge assembly are rotated by the same shaft. This assures that the relationship between the output of the pump 79 and the rotation of the centrifuge assembly remain constant.

Having described the features of this embodiment of the drawings, attention will now be directed toward an explanation of its operations. The material to be separated is injected through imput circuit 1. this may be the separation of two fluid mixtures or a fluid solid mixture. The fluid mixture is flowed upwardly through conduit tube 86 into the centrifuge dispenser chamber 2. From there it goes upwardly to a plurality of veins 3. When the separation operation started, the drive shaft 74 was also set in motion so that the centrifuge assembly including the veins 3 are rapidly rotated so that at the same time, pump 79 is also rotated at the same RPM. It is to be noted that the veins 3 are sealed by the two conical structures which hold the fluid and fluid solids and prevents them from flowing turbulently and mixing so that in the relatively quiet flow of the veins, the fluid and fluid solids will migrate upwardly and outwardly into a high rate of centrifugal field force. Because of the control of the fluids and fluid solids while in the centrifuge veins, there will also be a better separation than that taught in the prior art. Prior arts only teach one type of confinement. This teaches upward, outward and into the highest field of centrifugal force. All materials must move into that field. No other arts teach this. Prior arts teach circular confinement. All of the fluids and fluid solids must move into the extreme field of centrifugal force before they can exit the centrifuge assembly. The fluids and fluid solids can be retained in the centrifuge veins 3 as long as necessary. This is controlled by back pressure control in heavy material holding chamber 6 by use of valve 83 and in light material holding chamber 16 by judicious use of light material discharge valve 80. The control of the back pressure in relation with the pump 79, permits holding the fluids and fluid solids in a stable position until such time as it is deemed necessary to discharge them in an acceptable separation. It should further be understood that in some separations, it will not be necessary to hold any back pressure by valves 83 or 80.

In normal operation, all fluids must be passed between the scissor action of the knife 59 and the lower end of veins 3. This permits the accumulation of all sediments to be reduced to the size at least as small as the centrifugal vein openings at the lower end. As rotation continues, the denser material is forced outwardly and flows through dense discharge veins 4 which are clearly shown in FIG. 2 and passes the heavy material to the heavy material holding chambers 6. Subject to the revolutions per minute and the gravity of the material being separated, only those materials of a specific gravity weight can penetrate the field of gravity when the heavy material holding chamber is filled. When back pressure has built up in holding chambers 6 by closing down or completely closing heavy discharge valve 83 should there be materials in chamber 6 which is lighter or of a density not acceptable and such unwanted materials can be returned to the general flow stream which flows over less discharge weir vortex chamber 10. The backward sloping heavy material separation grooves which are located on the extreme top of the centrifuge housing are sloped at an angle so as the inner opening will not be completely blocked from the opening to the outer holding chamber. This is to allow for a centripetal slip path whereby, light materials which have, for various reasons, been passed out, to move back into the light material central vortex chamber. By closing the heavy discharge 83, the light materials can be passed back through the machine or by closing the light discharge, the lightest of the heavy materials can be passed back for another separation process. The angle of veins 4 will need to be varied depending upon the materials being separated. In general, the greater the specific gravity of the denser material the greater the backward slope. The slope is the angle which the center line vein 4 makes with a radial line extending from the center line of the centrifuge housing 28. A small angle e.g. 10°, tends to allow for a minimum centrifugal path but makes and retains a back pressure. A high backward angle e.g. 60° tends to block the centripetal path but has a high ability to build and maintain a back pressure. There will be times when it is necessary to flush the machine as well as to move a certain separation back to its original holding position for the purpose of recycling it for another separation when there is only one separator being used in a process. It must be remembered, that when the centrifuge is reversed, then the upper pump will also be reversed, which will, in turn, bring all pressure to bear on the point of original entry.

Figure 3:
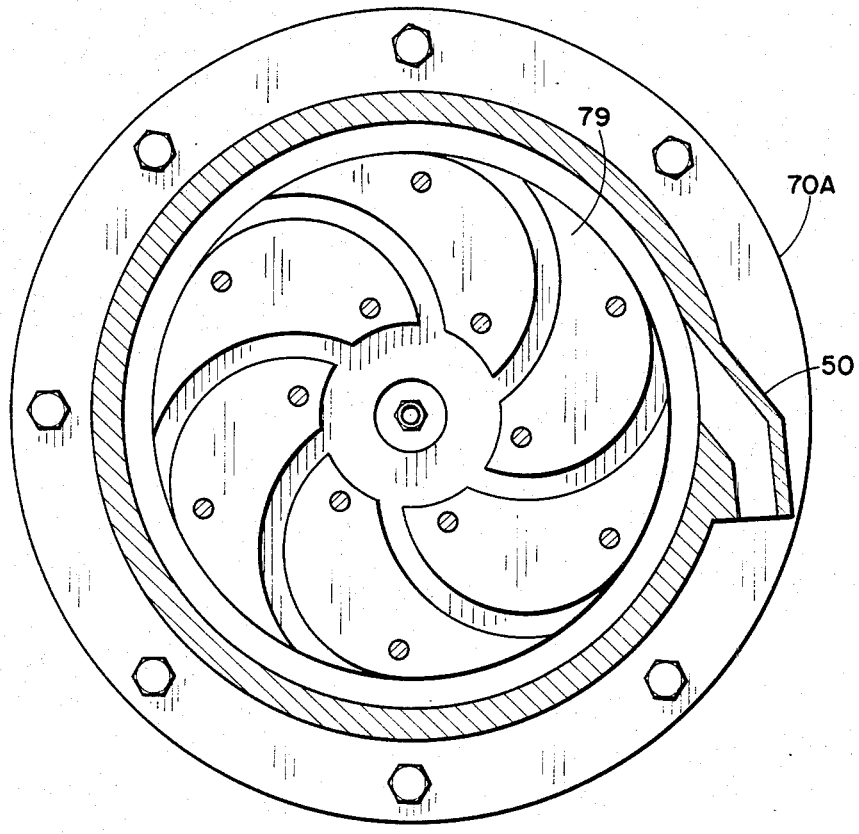
FIG. 3 is a sectional view taken along the line 3—3 of FIG. 1.
Figure 7:
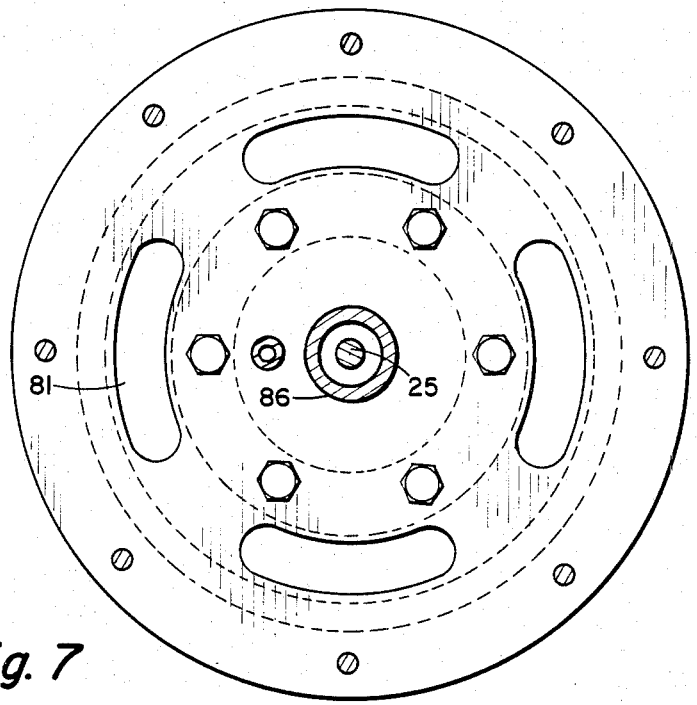
FIG. 7 is a view taken along the line 7—7 of FIG. 1.
Figure 4:
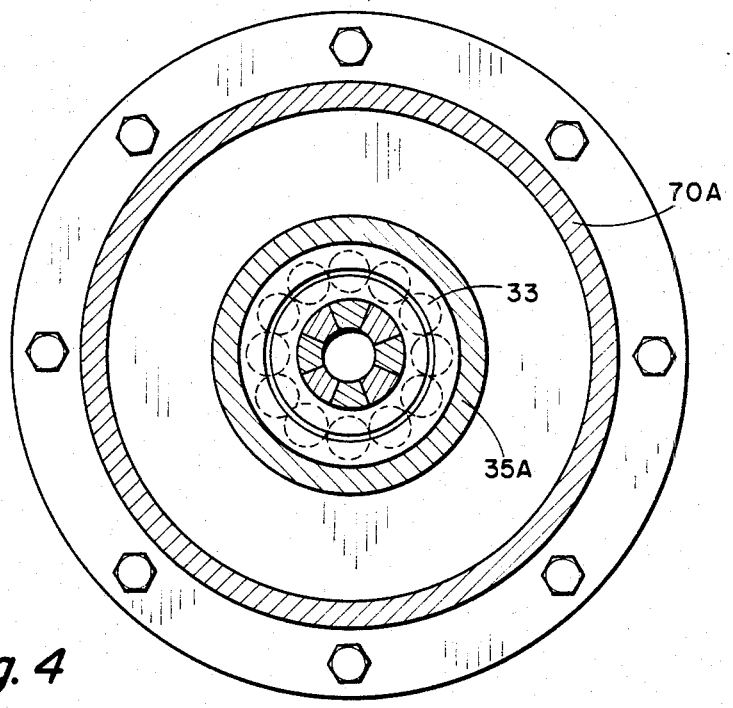
FIG. 4 is a view taken along the line of 4—4 of FIG. 1.
Figure 5:
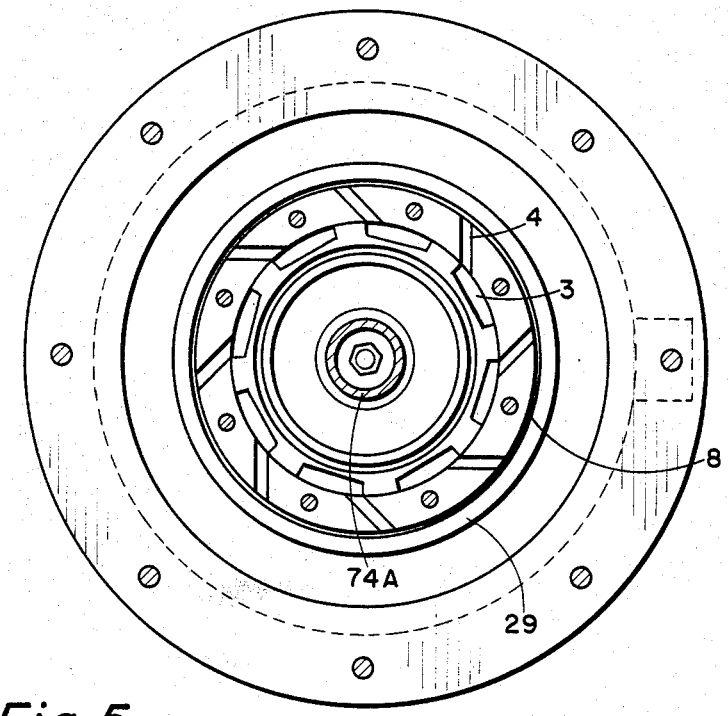
FIG. 5 is a sectional view taken along the line of 5—5 in FIG. 1.
Figure 6:
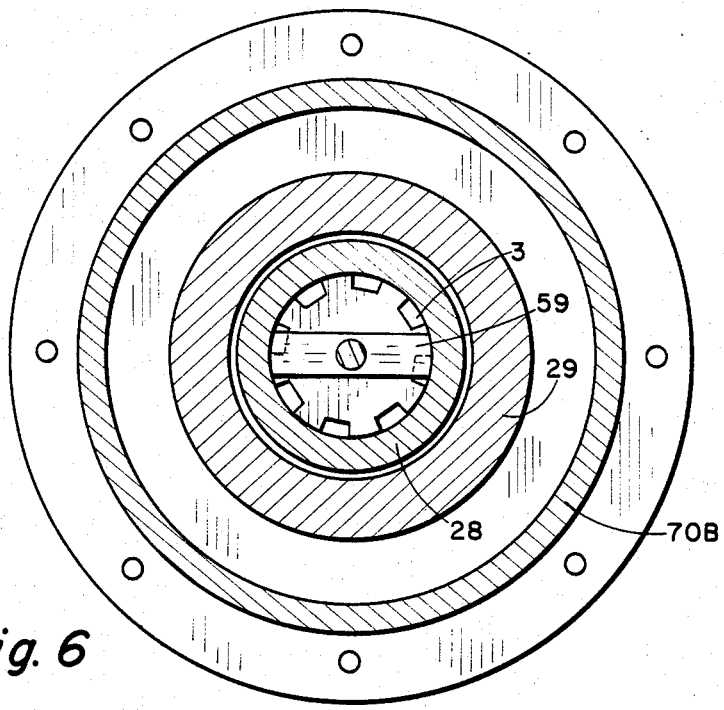
FIG. 6 is a sectional view taken along the line 6—6 of FIG. 1.

The dense material which is collected in the heavy material holding chamber 6 can be removed in one of two other ways. For example, it can be removed through a heavy discharge outlet 52 and valve 83 or if it is a solid, they can be passed through ports 81 into a lower holding chamber 82 where the solids can be periodically collected by any known means such as removing the lower chamber 82. Outlet 52 is preferably designed similar to light density outlet 50 shown in FIG. 3.

Should chemcial treatment be necessary to break down certain components, then that can be accomplished by injecting through adapter plug 90 in material imput adapter of block 85. In some instances, it may be desired to put it into adapter plugs 91 and 92 which can let into the heavy material holding chamber 6. We shall now discuss the exit path of the least dense material from vein 3. This includes a less dense discharge weir 75 into light material vortex chamber 10 which is inside fluid stabilizer vein 11. The exit is up through tube 74A through vortex pump 90 and into light material holding chamber 16 and eventually out through light material discharge 50 and light material discharge valve 80. A back pressure can be obtained in the light material holding chamber 16 but because of the central vortex pump 79, the materials cannot backtrack to the lower chamber 10 of the vortex. One can sample the discharge through light material discharge 50 and that through hevy discharge vein 7 and determine if proper separation is occuring. It might be that back pressure may have to be adjusted on either the lightweight material discharge or the heavy material discharge. By adjusting these back pressures, one can either increase or decrease the time which the fluid is being separated in the veins 3. Of course, increasing the time therein or the rotation, would tend to increase the degree of separation. The size and shape of veins 3 may vary depending upon the type of separation which is desired. The relationship between the input pressure of raw material and the outlet pressure of the material during separation is one of the factors that controls the degree of separation.

During this operation, the centrifuge cover clearance vein 18 which is a spacing between the central cover plate and the central bearing housing plate has as its main function, to reduce friction and to act as a shield against material that would tend to pass through the central bearing due to the back pressure build-up in the heavy material holding chamber 6. When the centrifuge is set in motion, then the centrifuge throw-out will clear any material that is in the space between the central bearing plate and the centrifuge cover plate and in doing so, will leave it free of friction buildup due to the would-be collection of composits of biosediments such as might occur in the separation involving oil such as motor oil.

While the invention has been described with a certain degree of particularity, it is manifest that many changes may be made in the details of construction without departing from the spirit and scope of the disclosure. It is understood that the invention is not limited to the embodiments set forth herein for purposes of exemplification but is limited only by the scope of the attached claim or claims including the full range of equivalancy to which each element thereof is entitled.

What is claimed is:

1. A centrifugal separator comprising:

a container;

a plurality of vortex centrifuge veins rotatably mounted within said container, said centrifuge veins defining truncated inverted right angle cone, each of said centrifuge veins flaring upwardly and outwardly with the cross-sectional area increasing as the cone gets larger;

outlet means connected to the upper end of said veins;

inlet means connected to the lower ends of said veins for admitting the fluid to be separated;

means to rotate said veins;

means connected to the outlet means of said veins for directing the denser material in one flow path and the less dense material in second flow path.

2. A separator as defined in claim 1 in which said vortex centrifuge veins are contained between a first truncated cone and a larger second truncated cone with a space therebetween and ribs on one or the other with the veins between the ribs thereof.

3. A separator as defined in claim 2 in which the outlet means includes discharge veins backward slanting from the direction of normal rotation in the top of said second truncated cone and each discharge vein in fluid communication with a selected one of said veins.

4. A separator as defined in claim 2 in which the upper end surface of said first truncated cone is sloping downwardly and inwardly and said ribs having the same slope and extending upwardly to the edge of the inner edge of the top of said second truncated cone.

5. A separator as defined in claim 4 including a vortex fluid stabilizer in the shape of a truncated cone mounted in a non-rotatable position within said first truncated cone.

6. A separator as defined in claim 5 including a knife supported in a non-rotatable position with respect to said housing adjacent the lower end of said inner cone to break up sediaments entering said centrifuge veins as said centrifugal housing and veins rotate.

7. An apparatus as defined in claim 6 including a low density material holding chamber in said container above said core defined by said centrifuge veins and low density material vortex chamber in the fluid stabilizes and a tube connected thereto and extending upwardly through a vortex discharge pump whose suction is connected to said tube and whose discharge is in said lightweight holding chamber;

discharge means from said lightweight material holding chamber;

means to rotate said vortex pump and said vortex centrifuge veins at the same RPM which matches or exceeds the output os the heavy material separator veins.

8. A separator as defined in claim 2 including a scatter wall shield closely surrounding said centrifuge housing and having a clearance vein therebetween.

9. A separator as defined in claim 2 including a fluid stabilizer closely fitting the inside wall of said first truncated cone housing and having a fluid stabilizer vein therebetween.

10. A separator as defined in claim 9 in which said second flow path is connected to a heavy material holding chamber within said container and outside scatter wall shield and functioning as a safety shield and centrifuge protector.

11. A centrifugal separator comprising:

a container;

a first truncated cone rotatably mounted in said container with the small end of the cone toward the bottom;

a second truncated cone housing mounted around said first truncated cone with a space therebetween and rotatably mounted in said container;

ribs on either said first or second truncated cone or fixed to both forming centrifuge veins between said ribs;

outlet means connected to the upper end of said centrifuge veins;

inlet means connected to the lower end of said centrifuge veins;

means to rotate said first truncated cone and said second truncated cone housing in unison;

means connected to the outlet means of said veins for directing the denser material in one flow path and the less dense material in a second flow path.

12. A separator as defined in claim 11 which the outlet means include discharge veins backwardly slanting from the direction of normal rotation of the first truncated cone and the second truncated cone in the top of said second truncated cone and each discharge vein and fluid communication with a selected one of said veins.

13. A separator as defined in claim 12 in which the upper end surface of said inner first cone is sloping upwardly and inwardly and said ribs having the same slope and extending upwardly to the inner edge of the top of said second cone.

14. A separator as defined in claim 12 including a vortex fluid stabilizer in the shape of a truncated cone mounted in a non-rotatable position within said first truncated cone.

15. A separator as defined in claim 12 including a knife supported in a non-rotatable position with respect to said housing adjacent the lower end of said first cone to break up sediments entering said centrifuge veins of said first truncated cone and said second truncated cone rotate in unison.

16. A separator as defined in claim 12 including a centrifuge cover secured to the top of said centrifuge housing; a retainer plate fixed to said container and positioned therein above said centrifuge cover and a centrifuge clearance vein between said centrifuge cover and said retainer plate.

* * * * *